US008395512B2

(12) United States Patent
Young et al.

(10) Patent No.: US 8,395,512 B2
(45) Date of Patent: Mar. 12, 2013

(54) SIGNATURE ANALYSIS SYSTEMS AND METHODS

(75) Inventors: Valerie J. Young, Portland, OR (US); Santosh Balakrishnan, Portland, OR (US); Todd Keaffaber, Lake Oswego, OR (US)

(73) Assignee: Sanvalto, Inc., Beaverton, OR (US)

( * ) Notice: Subject to any disclaimer, the term of this patent is extended or adjusted under 35 U.S.C. 154(b) by 469 days.

(21) Appl. No.: 12/731,084

(22) Filed: Mar. 24, 2010

(65) Prior Publication Data

US 2011/0234406 A1 Sep. 29, 2011

(51) Int. Cl.
*G08B 21/00* (2006.01)
*G08B 23/00* (2006.01)
*G08B 1/08* (2006.01)

(52) U.S. Cl. ..... 340/573.1; 340/669; 340/670; 340/539.11; 340/539.22; 340/539.12

(58) Field of Classification Search ..... None
See application file for complete search history.

(56) References Cited

U.S. PATENT DOCUMENTS

| | | | | |
|---|---|---|---|---|
| 7,020,701 | B1 * | 3/2006 | Gelvin et al. | 709/224 |
| 8,109,858 | B2 * | 2/2012 | Redmann | 482/8 |
| 2007/0069887 | A1 * | 3/2007 | Welch et al. | 340/539.12 |
| 2007/0232275 | A1 * | 10/2007 | Collins et al. | 455/413 |
| 2008/0001735 | A1 * | 1/2008 | Tran | 340/539.22 |
| 2008/0021532 | A1 * | 1/2008 | Kveen et al. | 607/115 |
| 2010/0217533 | A1 * | 8/2010 | Nadkarni et al. | 702/19 |
| 2010/0244576 | A1 * | 9/2010 | Hillan et al. | 307/104 |
| 2011/0061647 | A1 * | 3/2011 | Stahmann et al. | 128/202.16 |

* cited by examiner

*Primary Examiner* — Wayne Young
*Assistant Examiner* — Fekadeselassie Girma
(74) *Attorney, Agent, or Firm* — Marger, Johnson & McCollom PC

(57) ABSTRACT

A signature analysis system can include a mobile signature analysis unit and a home unit. The mobile signature analysis unit can include a sensor module to monitor and capture an entity's activity information and a processing unit to analyze the activity information to detect a signature and determine an event corresponding to the signature. If the mobile signature analysis unit determines that a user has experienced a fall, for example, a notification can be sent to the user's caregiver by one or both of the mobile signature analysis unit and the home unit.

14 Claims, 7 Drawing Sheets

SIGNATURE ANALYSIS SYSTEMS AND METHODS

TECHNICAL FIELD

The disclosed technology pertains to analyzing signatures, such as signatures corresponding to various types of user activities.

BACKGROUND

As the world's population continues to age, the number of people expecting to become caregivers of a loved one grows at an increasing rate. Other populations, such as working parents with children, disabled people, and chronically ill patients also tend to require some level of care. The amount of stress upon a typical caregiver can be enormous. For example, many caregivers tend to lose a non-trivial and often significant amount of their wages, benefits, and free time in order to care for their loved ones. In addition, many people in need of care, particularly senior citizens, generally wish to age in peace. That is, these care recipients generally prefer to not be placed in a care facility, such as a nursing home.

Many care recipients tend to prefer that caregivers not be a regular part of their lives; rather, care recipients may desire that caregivers only become involved on an as-needed basis, e.g., in case of emergency. In addition, it may not be feasible for a caregiver to maintain a constant presence with the care recipient as the caregiver may have a full-time job away from the care recipient, for example. Furthermore, the provision of constant attention by a caregiver can be an inefficient use of time and may consequently result in an overall reduction in the quality of care provided by the caregiver, particularly in the case of a care recipient that is generally in good health.

Thus, there remains a need for a way to address these and other problems associated with the prior art.

SUMMARY

A signature analysis system can include a home unit and at least one mobile signature analysis unit associated with the home unit. A mobile signature analysis unit, suitable to be worn by an entity, e.g., a human user, can actively monitor and analyze the entity's activity. For example, the mobile signature analysis unit can determine whether a user has experienced a fall. The mobile signature analysis unit can have a sensor device, such as an accelerometer, for collecting information pertaining to the entity's activity, e.g., motion, based on the mobile unit experiencing an acceleration in each of two or more spatial directions, for example.

The mobile signature analysis unit can actively process the information collected by the sensor device. For example, a processing unit can analyze various characteristics and values of the signal to determine whether a fall event is suspected. By using a two-level filter process when determining whether a fall has occurred, for example, the mobile signature analysis unit can effectively screen out a number of different false positives such as a signal corresponding to the entity jumping or running. This determination can be made based on multiple changes in acceleration in two or more spatial directions within a given time period as well as an energy impulse value corresponding to the signal.

Once a certain event has been detected by the mobile signature analysis unit, the unit can send a notification to alert one or more locations, e.g., caregivers, to the detected event. For example, the mobile signature analysis unit can communicate with the home unit, which can send the notification to the caregivers through a network using a particular communication modality corresponding to each pertinent caregiver. If the mobile signature analysis unit is out of range of the home unit, or if the home unit is turned off or presently experiencing some technical issues, the mobile signature analysis unit can actively connect to a communication device, such as a cellular telephone, and direct the communication device to transmit the notification to the proper destination.

The foregoing and other features, objects, and advantages of the invention will become more readily apparent from the following detailed description, which proceeds with reference to the accompanying drawings.

DETAILED DESCRIPTION

Figure 1:
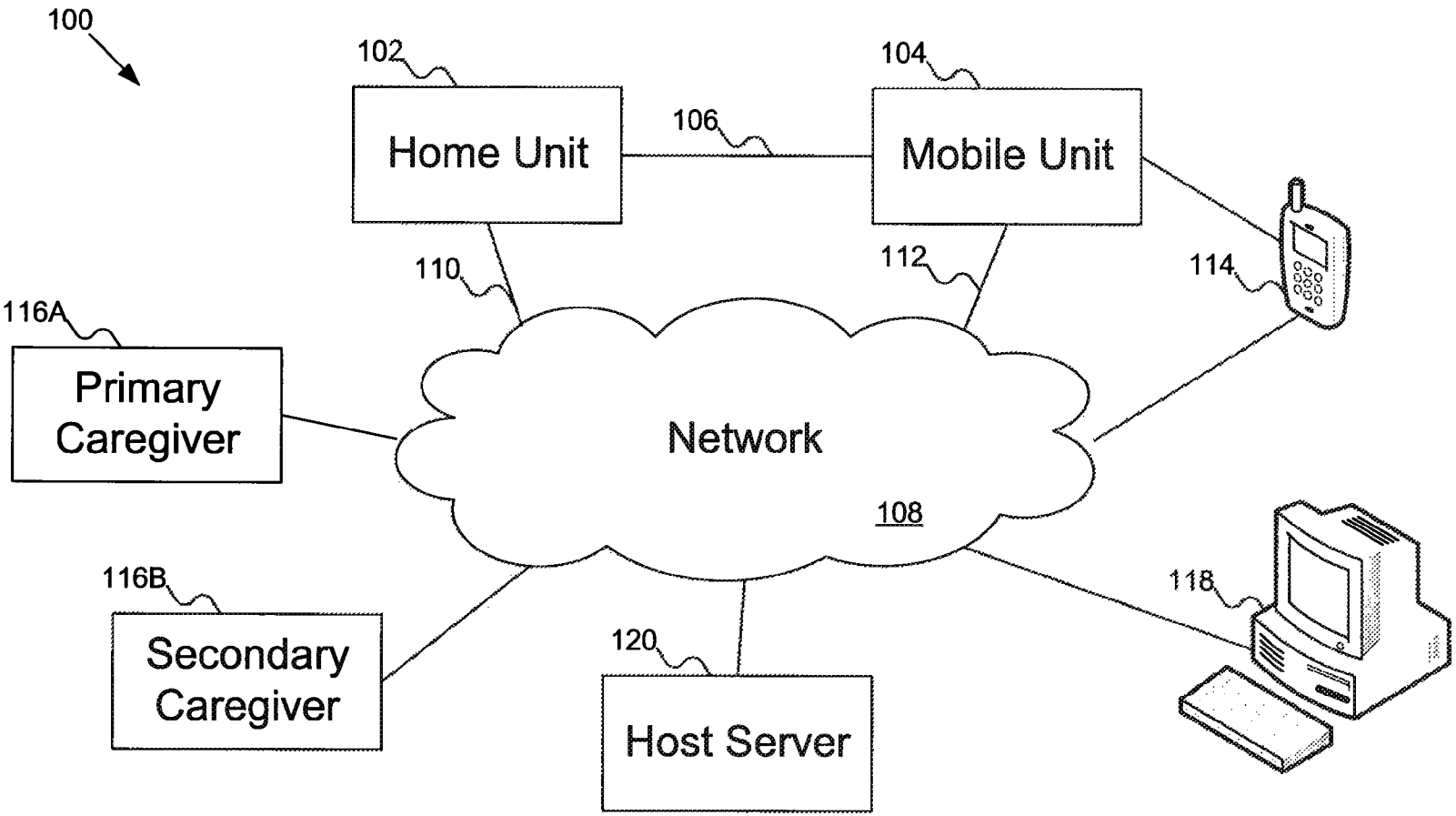
FIG. 1 is a block diagram that illustrates an example of a signature analysis system in accordance with embodiments of the disclosed technology.

FIG. 1 is a block diagram illustrating an example of a signature analysis system 100. In the example, the signature analysis system 100 includes a home unit 102 and a mobile signature analysis unit 104. The home unit 102 and the mobile signature analysis unit 104 can communicate with each other by way of a connection 106. In certain embodiments, the connection 106 is a wireless connection. Alternatively, the connection 106 can be a physical, e.g., hard-wired, connection.

In situations where the mobile signature analysis unit 104 is running low on power or if the power source has failed or become disconnected, an entity can temporarily connect or re-connect the mobile signature analysis unit 104 to the home unit 102 using the connection 106. This arrangement can enable the mobile signature analysis unit 104 to receive operating power from the home unit 102 and, if the power source of the mobile signature analysis unit 104 is simply in need of a recharge, the home unit 102 can provide such a recharge while the mobile signature analysis unit 104 is connected thereto.

In certain embodiments, the mobile signature analysis unit 104 can be worn by an entity, e.g., a human user. For example, the user can wear the mobile signature analysis unit 104 by way of a wristband, an armband, a belt, or other comparable accessory. Alternatively, the user can wear the mobile signature analysis unit 104 as a pendant or as a broach. Because the mobile signature analysis unit 104 can be worn by the user in any of a number of different ways, the user can take into account factors such as comfort and accessibility when deciding how to wear the unit. Also, the user can wear the mobile signature analysis unit 104 either outside his or her clothes or underneath. For example, a female user may attach the mobile signature analysis unit 104 to a bra strap or other piece of under-clothing. The user may wish to do this to conceal the mobile signature analysis unit 104 from the view of others and thus avoid any potential embarrassment that she may feel if she knew that others could see her wearing the mobile signature analysis unit 104.

The mobile signature analysis unit 104 can provide the home unit 102 with information pertaining to the entity. In particular, the mobile signature analysis unit 104 can determine whether the entity has experienced a fall and, responsive to a determination that the entity has indeed experienced a fall, provide a notification to the home unit 102 by way of the connection 106. The notification can include information pertaining to the fall such as the duration or severity of the fall, for example. In certain embodiments, the notification can also include information pertaining to the entity's location at the time of the fall.

In the example, the system 100 also includes a network 108. The network 108 can be any of a number of different network types such as a wide area network (WAN), a local area network (LAN), broadband, telephonic, cellular, or any combination thereof. The home unit 102 can connect to the network 108 by way of a connection 110. The connection 110 can be a physical connection, e.g., a wired connection, or a wireless connection. The mobile f signature analysis unit 104 can connect to the network 108 by way of a connection 112 that is typically wireless but can alternatively be a physical connection, e.g., a wired connection. The mobile signature analysis unit 104 can also connect to the network 108 by way of a mobile communication device 114 such as a cellular telephone, personal digital assistant (PDA), or other electronic device.

An entity can select or be assigned to one or more caregivers 116. As used herein, the caregivers 116 can include personal contacts selected by the entity, medical personnel assigned to the entity, such as a user's doctor or nurse, other people or services, or any combination thereof. The caregivers 116 can be in connection with the network 108 to receive alerts concerning the entity. For example, each of the caregivers 116 can have a personal communications device, such as a cell phone, or a personal computing device, such as a laptop, that is able to receive information from the network 108. In certain embodiments, each caregiver's personal communications device or personal computing device can actively maintain a connection to the network 108.

When the mobile signature analysis unit 104 determines that the entity has experienced a certain event such as a fall, one or more of the caregivers 116 can receive a notification reporting the event from the home unit 102 or the mobile signature analysis unit 104 by way of the network 108. The system 100 can maintain a list of caregivers 116, including a certain caregiver designated as the primary caregiver 116A. If the primary caregiver 116A is not connected to the network 108 when the user experiences a fall, for example, the system 100 can select another caregiver 116B. If none of the caregivers 116 are connected to the network 108, the system 100 can perform another action such as calling an emergency services number, e.g., 911.

In certain embodiments where the mobile signature analysis unit 104 determines that the user has suffered a fall, the mobile signature analysis unit 104 can first determine whether it is within range of the home unit 102. If so, the mobile signature analysis unit 104 can send a notification to the home unit 102 and the home unit 102 can then alert the caregiver(s) 116 using the network 108. If not, however, the mobile signature analysis unit 104 can send the notification to the caregiver(s) 116 directly through the network 108 by way of the direct connection 112 or indirectly by using a mobile communication device 114.

A computer 118, such as a user's home computer, can also be connected to the network 108. In certain embodiments, the computer 118 can maintain information pertaining to the entity such as a running log of event activity. For example, the system 100 can be set up such that each time the mobile signature analysis unit 104 detects a fall suffered by the user, the mobile signature analysis unit 104 or home unit 102 can notify the computer 118 of the fall event and provide the computer 118 with information concerning the fall event. The computer 118 can store this information in an entity activity log file, for example.

Alternatively or in addition thereto, the mobile signature analysis unit 104 or home unit 102 can also send event-related information to a host server 120. In certain embodiments, the host server 120 is a remote storage device that maintains event-related information for any of a number of given entities that each have a home unit and a mobile signature analysis unit 104. In certain embodiments, multiple entities can each have an individual mobile signature analysis unit 104 that communicates with a single home unit 102. This arrangement can be particularly advantageous in certain environments, such as nursing homes or elderly care facilities, where a number of people may live in relatively close proximity to each other.

One or more instances of a signature database can be implemented in one or more of the home unit 102, the mobile signature analysis unit 104, the computer 118, and the host server 120. In certain embodiments, the signature database can store one or more signature templates that each correspond to a particular event, such as a fall, a jump, a clap, walking, and running. One or both of the mobile signature analysis unit 104 and the home unit 102 can access this signature database as part of the signature analysis process. For example, the mobile signature analysis unit 104 can analyze a signal provided by a sensor device, such as an accelerometer, to determine a signature of the signal and then compare the signature to one or more of the signature templates stored in the signature database to characterize the monitored event.

In certain embodiments, the mobile signature analysis unit 104 can first compare the signature of the signal to the signature template corresponding to a fall. If there is an identical match or at least a substantially similar match, the mobile signature analysis unit 104 can characterize the monitored event as a fall event and initiate certain procedures responsive to the characterization. If there is no match or no more than an insubstantial match, however, the mobile signature analysis unit 104 can proceed to compare the signature of the signal to the other signature templates in the signature database until a positive match is found.

If no match is found with any of the stored signature templates, the signature analysis system 100 can disregard the monitored event as an anomaly, for example. Alternatively, the system 100 can store the unidentified event for future use. For example, if there are several events having a similar signature over a certain period of time, the signature analysis system 100 can flag the event as an event of interest and provide an opportunity to create a new signature template corresponding to the event to be used in connection with future monitoring. Signature templates can correspond to, but are not limited to, the following event types: light clapping, heavy clapping, bumping, waving, walking, jumping, plopping, swinging, dancing, punching, bending, sitting, and intentionally lying down.

Mobile Signature Analysis Units in Accordance with the Disclosed Technology

Figure 2:
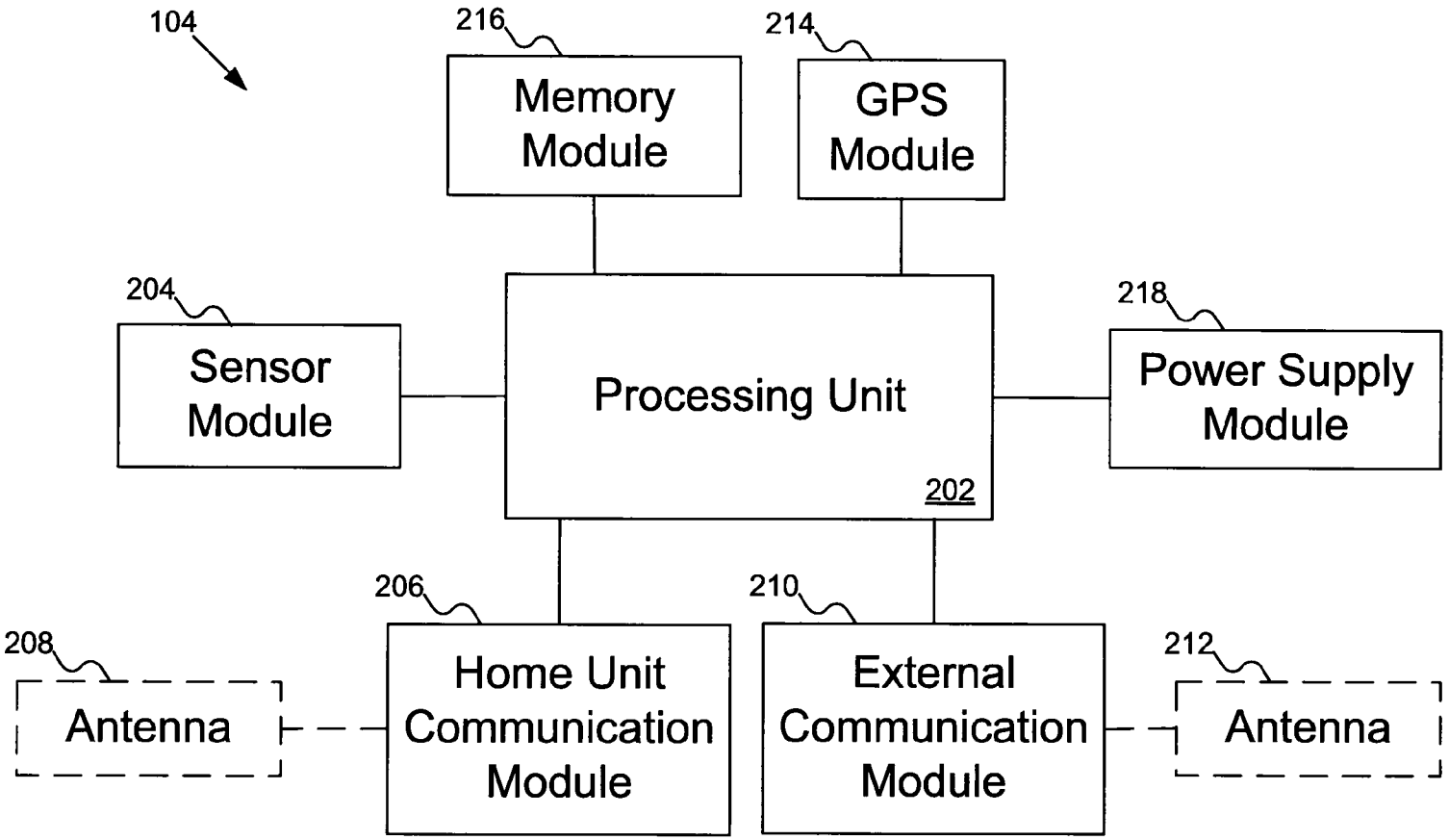
FIG. 2 is a block diagram that illustrates an example of a mobile signature analysis unit in accordance with embodiments of the disclosed technology.

FIG. 2 is a block diagram illustrating a detailed example of the mobile signature analysis unit 104 of FIG. 1. The mobile signature analysis unit 104 has a sensor module 204 that can provide information to a processing unit 202. In certain embodiments, the sensor module 204 includes one or more sensor devices such as accelerometers. Each accelerometer can use a capacitance-based technique to measure the acceleration experienced by the accelerometer. The accelerometer output is typically a voltage that is linearly proportional to the measured acceleration. The accelerometer can also output the acceleration measurements in a digital format. The information provided by the sensor module 204 to the processing unit 202 can include a value for each spatial direction, i.e., the x-axis, the y-axis, and the z-axis.

The processing unit 202 can determine whether the entity has experienced a particular event based on the information received from the sensor module 204. For example, the processing unit 202 can evaluate the received information to determine whether there have been directional changes in the entity's total acceleration in at least two spatial directions. The processing unit 202 can do this by determining whether the voltage signal from the accelerometer has two inflection points in each of at least two spatial directions within a certain period of time, for example. In certain embodiments, the processing unit 202 can apply an algorithm to identify within a first spatial direction two inflection points that have a height difference of more than 1 g (9.8 $m/s^2$) of acceleration and are both within a 784-millisecond time window.

The processing unit can also apply the same algorithm to one or both of the second and third spatial directions. In certain embodiments where the processing unit 202 has identified a positive match in the first spatial direction, however, the processing unit can use different parameters when applying the algorithm to the subsequent spatial direction(s). For example, the height difference between two inflection points in the second spatial direction within a given time window can be lesser or greater than the height difference used in connection with the first spatial direction. Such arrangements can account for the entity wearing the mobile signature analysis unit 104 in random orientations with respect to the Earth's reference frame.

In certain embodiments, by evaluating information for two or more spatial directions, the processing unit 202 can effectively reduce the number of false positives that may result from non-fall activity such as running or hopping from a wheelchair to a bed. While such activities may have signal characteristics that are similar to those found in a signal corresponding to a fall event, such characteristics of the former typically occur in only a single spatial direction. Thus, by evaluating two or more spatial directions, the processing unit 202 can filter these events that would likely otherwise be identified as a fall if the processing unit 202 considered a single spatial direction only.

In the example, the mobile signature analysis unit 104 has a home unit communication module 206 that, in certain embodiments, can use a first antenna 208. The home unit communication module 206 can incorporate one or more of a number of different protocols, specifications, and techniques. For example, the mobile signature analysis unit 104 can be configured to communicate with the home unit 102, if within range of the home unit 102, using a ZigBee chip as part of the home unit communication module 206.

In situations where the mobile signature analysis unit 104 determines that the entity has experienced a certain event, such as a fall, but cannot connect to the home unit 102 because the mobile signature analysis unit 104 is outside of the active range of the home unit 102 or the home unit 102 is currently powered down or experiencing a technical issue, for example, the mobile signature analysis unit 104 can use an external communication module 210 that can use a second antenna 212. In certain embodiments, the mobile signature analysis unit 104 can connect to a mobile communication device 114 using a Bluetooth chip as part of the communication module 210. The mobile signature analysis unit 104 can thus provide a notification to the caregiver(s) 116 through the network 108 by way of the mobile communication device 114.

In the example, the mobile signature analysis unit 104 includes a global positioning system (GPS) module 214 that can be used to determine a geographic location of the mobile signature analysis unit 104 itself and, therefore, a geographic location of the entity that is presumed to be wearing the unit. Thus, in situations where the mobile signature analysis unit 104 detects a certain event such as a fall, the unit can send a notification that includes geographic location information to help the caregiver(s) 116 locate the entity. While the signature analysis system 100 can assume that the entity is within a close proximity to the home unit 102 if the notification is sent by the home unit 102, the signature analysis system 100 would need certain information to locate the entity if the entity is outside the range of the home unit 102. The GPS module 214 can provide such information to assist in locating the entity that may have experienced a fall.

In certain embodiments, the mobile signature analysis unit 104 can include a memory module 216 configured to store various types of information pertaining to the entity, the mobile signature analysis unit 104, the home unit 102, and virtually any other aspect of the systems described herein. For example, the memory module 216 can store data used to define a number of different signatures that each correspond to a certain type of activity such as a fall, a jump, running, skipping, etc. Thus, the processing unit 202 can access the memory module 216 when evaluating information received from the sensor module 204 to determine whether the user has experienced a fall, for example.

The memory module 216 can also store various types of information pertaining to both fall and non-fall events. Each time the processing unit 202 identifies a fall, for example, the processing unit 202 can edit an existing entry or create a new entry within the memory module 216 that corresponds to the detected fall. The entry can include information such as the time, duration, severity, and geographic location of the identified fall. If the determination is later identified as having been incorrect, however, the entry can be updated to reflect that the event was a false positive. Over time, a history can thus be established and used to determine the accuracy and effectiveness of the mobile signature analysis unit 104, for example. Alternatively or in addition thereto, the history can be considered part of the entity's medical records and can be provided to the entity's doctor(s) or other medical personnel.

In the example, the mobile signature analysis unit 104 has a power supply module 218 that typically includes one or more batteries to allow the entity to move freely with the mobile signature analysis unit 104 on his or her person, unencumbered by any wires or cables to provide the operating power. In certain embodiments, the power supply module 218 includes a rechargeable battery that can be recharged by the home unit 102. When the entity goes to sleep, for example, he or she can connect the mobile signature analysis unit 104 to the home unit 102. Upon waking, the entity can disconnect the mobile signature analysis unit 104 from the home unit 102 and begin using the unit immediately, knowing that the battery has been at least partially charged.

In certain embodiments, the mobile signature analysis unit 104 can have a relatively small size, e.g., 1 inch by 1.3 inch by 0.75 inch, thereby allowing an entity to wear the unit in a number of different, unobtrusive, and comfortable ways, e.g., on the hip, on the wrist, in a pocket, as a broach, or as a pendant, for example. In certain embodiments, the mobile signature analysis unit 104 can have a waterproof housing such that it is waterproof to 10 feet, for example, and can thus be worn while the entity is taking a shower or bath. Also, because the mobile signature analysis unit 104 is generally orientation-independent, the entity is typically not required to wear the mobile signature analysis unit 104 at a certain location on his or her person or in a certain orientation.

While the operations performed by the mobile unit as described herein are generally automatic, the mobile signature analysis unit 104 can have a button, which may be referred to herein as a panic button, to direct the mobile signature analysis unit 104 to proactively issue a notification or alert to one or more of the caregivers 116. The mobile signature analysis unit 104 can also have other features, such as a battery indicator to indicate a low power condition and provide a recommendation that the entity recharge the unit within a certain period of time. In certain embodiments, the power supply module 218 can include a battery or battery pack having a life of up to or even over one month per charging.

Home Units in Accordance with the Disclosed Technology

Figure 3:
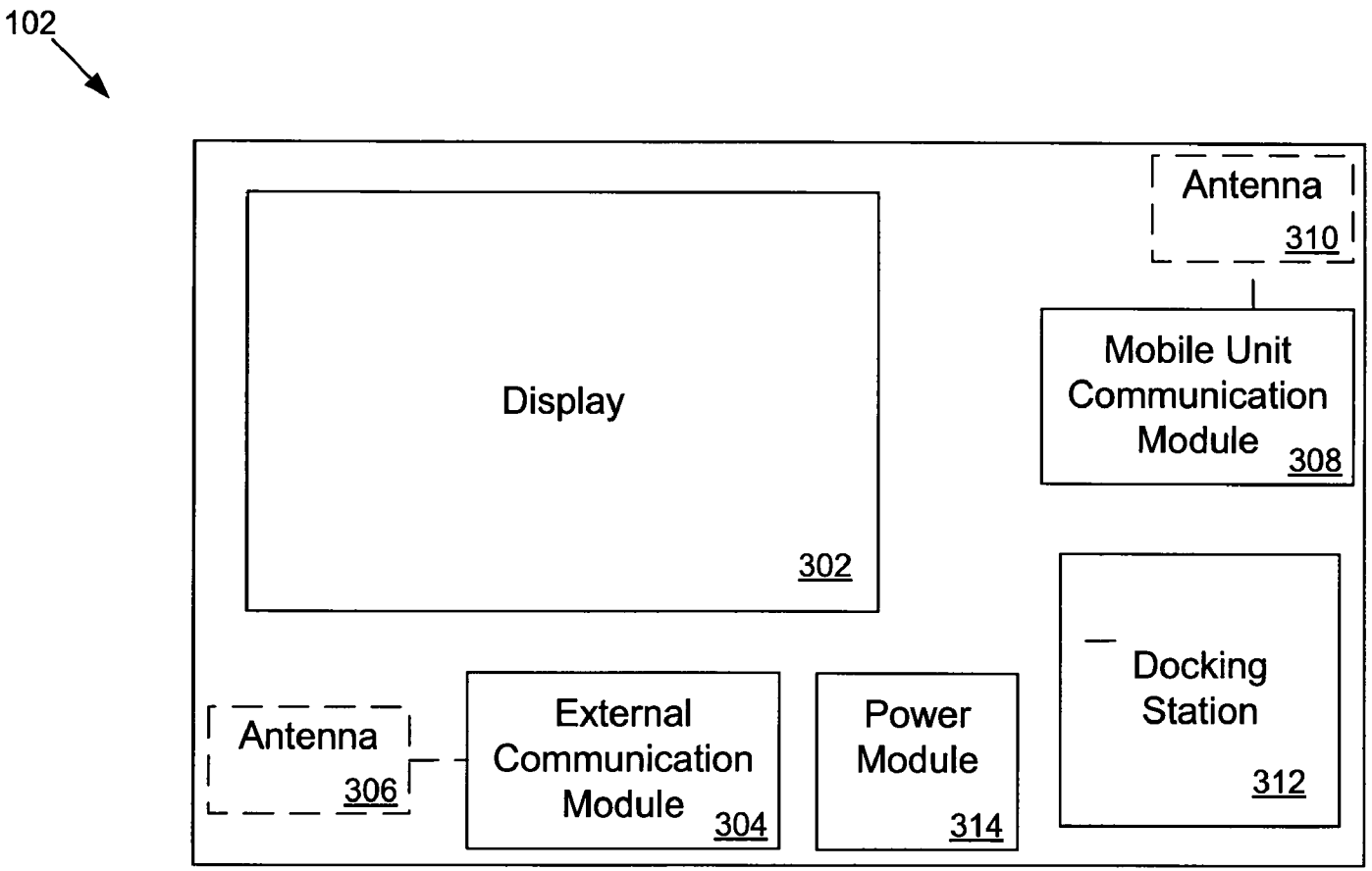
FIG. 3 illustrates an example of a home unit in accordance with embodiments of the disclosed technology.

FIG. 3 illustrates a detailed example of the home unit 102 of FIG. 1. In the example, the home unit 102 has a display 302 that can provide a user with various types of information pertaining to the home unit 102 itself, one or more mobile signature analysis units 104 associated with the home unit 102, or any combination thereof. For example, the display 302 can provide information about one or more falls, if any, experienced by a user of an associated mobile signature analysis unit 104. The display 302 can also provide information as to whether a mobile signature analysis unit 104 is running low on power, outside the range of the home unit 102, or currently experiencing a technical issue.

The display 302 can also provide various types of information pertaining to the other components of the system 100 illustrated in FIG. 1. For example, the display 302 can indicate whether one of more of the caregivers 116 are currently connected to the network 108. The display can also indicate who or what is currently designated the primary caregiver 116A and who or what is currently designated the secondary caregiver 116B. The display 302 can also enable an entity to add one or more new caregivers or remove one or more existing caregivers. The display 302 can also allow the entity to re-assign who should be the primary and secondary caregivers 116A and 116B, respectively.

In certain embodiments, the display 302 can serve as a user interface to the computer 118, the host server 120, or both. For example, a user can access personal information, including medical history information, that may be stored on one or both of the computer 118 and the host server 120. In certain embodiments, the display 302 can allow the user to alter such information. If the last recorded fall event was actually a false positive, for example, the user can update the corresponding record accordingly using the display 302 to make the changes.

The home unit 102 has an external communication module 304 that can be used to communicate with certain entities using any of a number of different protocols and techniques such as an Ethernet connection, a wireless fidelity (Wi-Fi) connection, a Worldwide Interoperability for Microwave Access (WiMAX) connection, and a universal asynchronous receiver/transmitter (UART), for example. In certain embodiments, the home unit 102 can use the external communication module 304 to send event detection notifications through the network 108 to one or more caregivers 116. Also, the home unit 102 can facilitate interactions with one or both of the computer 118 and host server 120, such as those discussed above, by way of the external communication module 304 and the network 108 by way of a web browser, for example. In certain embodiments, the home unit 102 can use a first antenna 306 in connection with the external communication module 304.

In the example, the home unit 102 includes a mobile unit communication module 308 that can be used to communicate with one or more mobile signature analysis units 104 associated with the home unit 102. The mobile unit communication module 308 can implement any of a number of communication protocols and techniques such as a ZigBee module to connect with a ZigBee chip on a mobile signature analysis unit 104, for example. In certain embodiments, the home unit 102 can use a second antenna 310 in connection with the mobile unit communication module 308.

The home unit 102 can include a docking station 312 configured to physically couple with a mobile signature analysis unit 104. For example, the docking station 312 can be shaped and sized such that it can hold a mobile signature analysis unit 104 in place. The docking station 312 can also provide an electrical connection between the home unit 102 and the mobile signature analysis unit 104 for as long as the mobile signature analysis unit 104 remains within the docking station 312. In certain embodiments, the electrical connection can enable communications between the home unit 102 and the mobile signature analysis unit 104. The electrical connection can also allow the home unit 102 to charge a power supply module 218 of the mobile signature analysis unit 104.

In the example, the home unit 102 has a power module 314 that can provide the home unit 102 with operating power. For example, the power module 314 can be one or both of an adapter for receiving power from an outside power source, such as an electrical outlet, or from one or more batteries, such as a rechargeable battery pack located within a main body of the home unit 102. The power module 314 can be swappable such that the home unit 102 can be plugged into a wall when the user is at home or use a battery if the entity wishes to take the unit with him or her on an extended trip or vacation, for example.

Machine-Controlled Methods in Accordance with the Disclosed Technology

Figure 4:
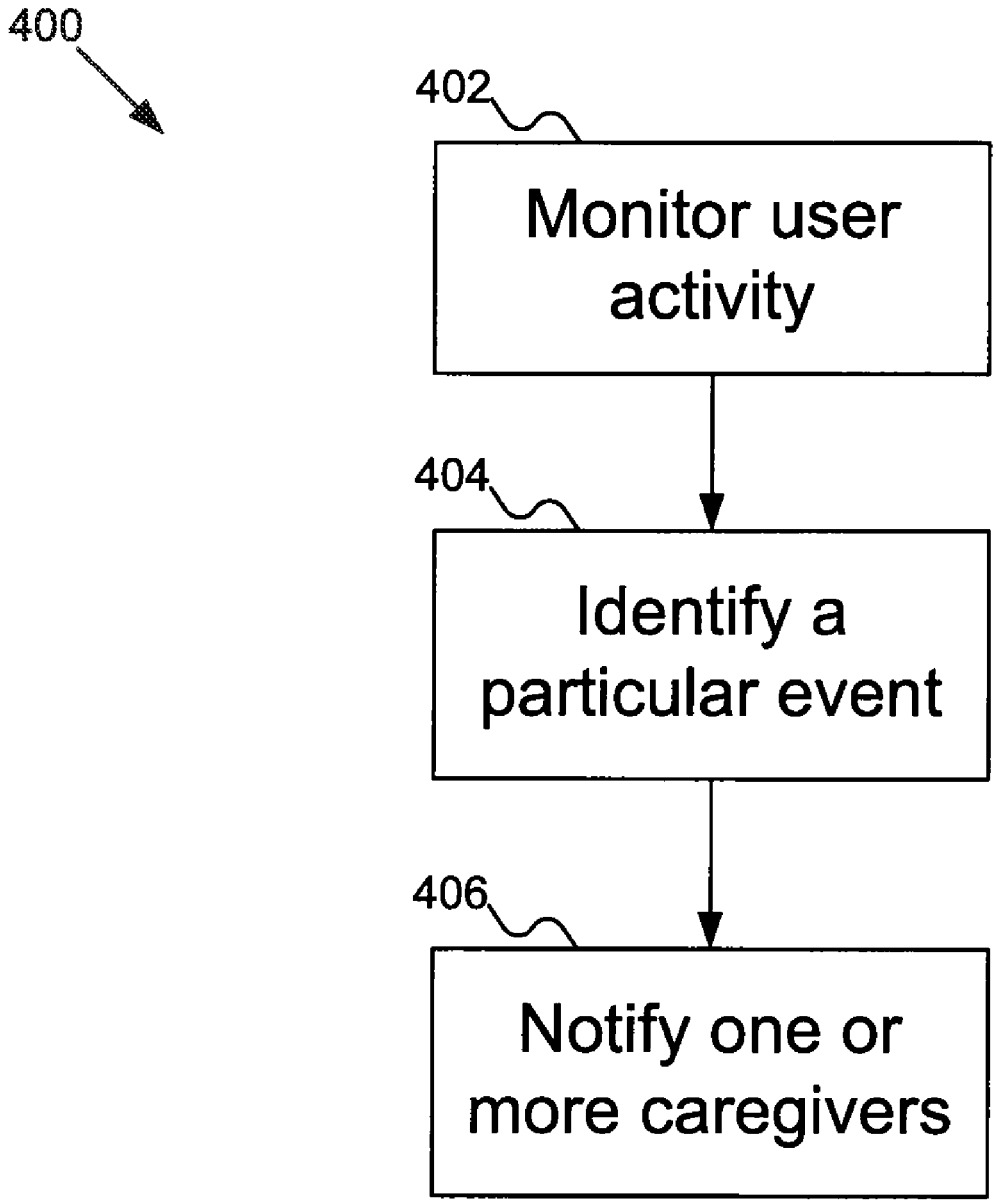
FIG. 4 is a flowchart that illustrates an example of a machine-controlled method of signature analysis and notification in accordance with embodiments of the disclosed technology.

FIG. 4 is a flowchart that illustrates an example of a machine-controlled method 400 of signature analysis and notification. At 402, an entity's activity is monitored. A sensor device, such as an accelerometer, can be used to obtain information pertaining to the entity's actions. The sensor device can obtain such information on a constant basis, at a certain time interval, or responsive to particular instructions, for example. In certain embodiments, the sensor device can be instructed to only send information if there is a change therein. For example, if the entity is completely or at least substantially still, e.g., sitting down while reading a book, there will be little to no motion and, therefore, the monitored information will have no more than an insubstantial amount of variance and would be of little interest with respect to a determination as to whether a certain event, such as a fall, has occurred.

At 404, a particular event, e.g., a fall, is identified. For example, if the entity does indeed experience a fall event, the sensor device will typically register a significant change in the entity's motion and location in space. This information can be provided to a processing unit of a mobile signature analysis unit, which can analyze the received data to determine that the entity has experienced a fall. This process is discussed in greater detail below with respect to FIG. 5.

At 406, at least one caregiver, e.g., a relative, friend, medical professional such as a doctor or nurse, or other person or service selected by or assigned to a particular entity, is notified of the detected fall. Upon receiving the notification, the caregiver can attempt to contact the entity by telephone, for example, or travel directly to the entity's location to check on the entity. If the entity is an elderly person living at a facility such as a nursing home, for example, it may make the most sense for the caregiver to go directly to the person's room as such action may be even quicker than attempting to call the person. The caregiver can then assess whether the user has indeed suffered a fall and, if so, whether the user requires any medical attention.

Figure 5:
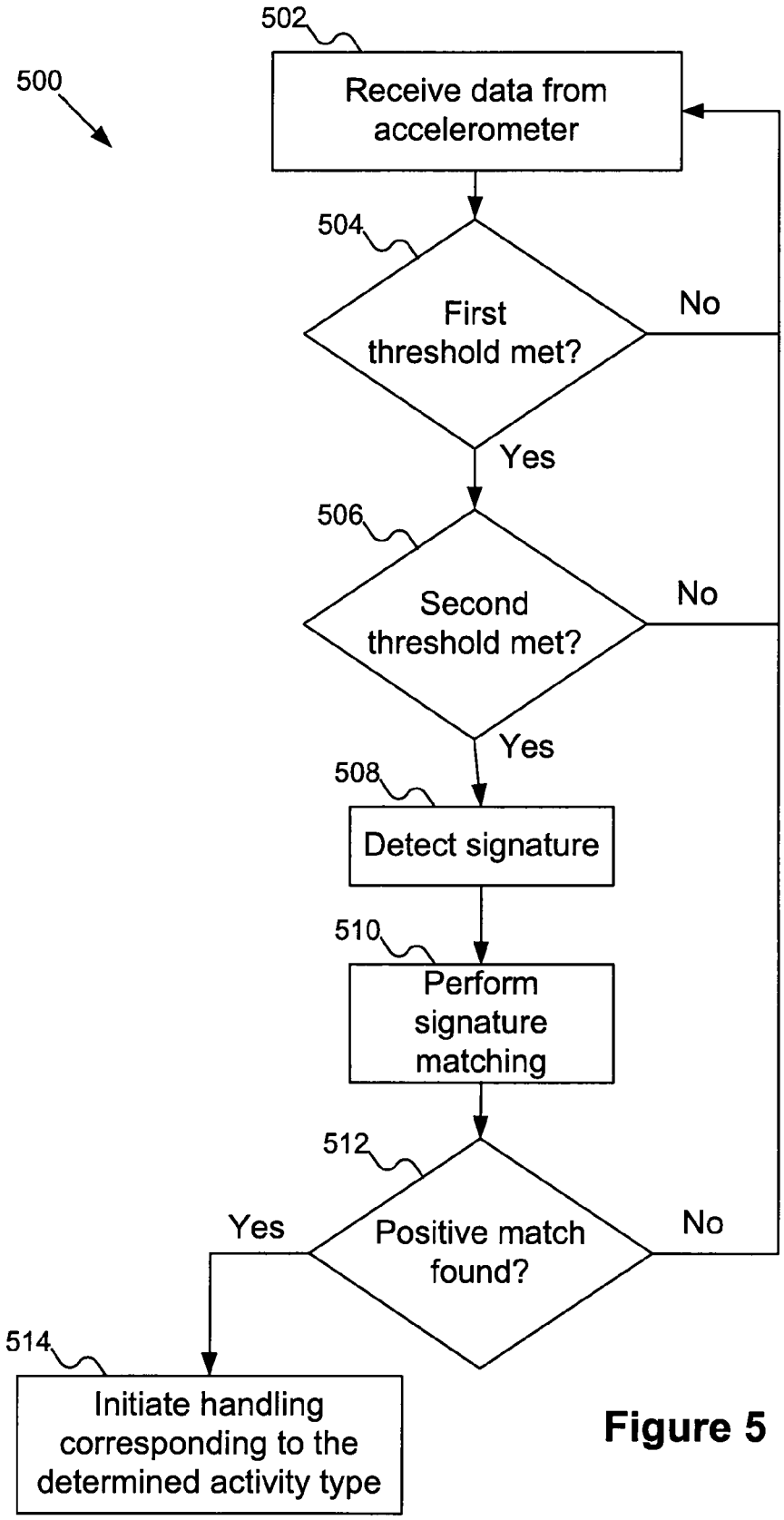
FIG. 5 is a flowchart that illustrates a more detailed example of a machine-controlled method of signature analysis and notification in accordance with embodiments of the disclosed technology.

FIG. 5 is a flowchart illustrating a more detailed example of a machine-controlled method 500 of signature analysis and notification. At 502, a mobile signature analysis unit 104 receives data from an accelerometer such as a triaxial accelerometer, for example. While the example describes a single accelerometer, one having ordinary skill in the art will appreciate that, in certain embodiments, multiple accelerometers can be used. In situations where an entity wearing the mobile signature analysis unit 104 experiences a fall event, for example, the signal data from the accelerometer will typically exhibit an increasing acceleration in at least two spatial directions accompanied by two directional changes in acceleration in at least one of the spatial directions within a relatively short time window, e.g., 800 milliseconds.

Figure 6:
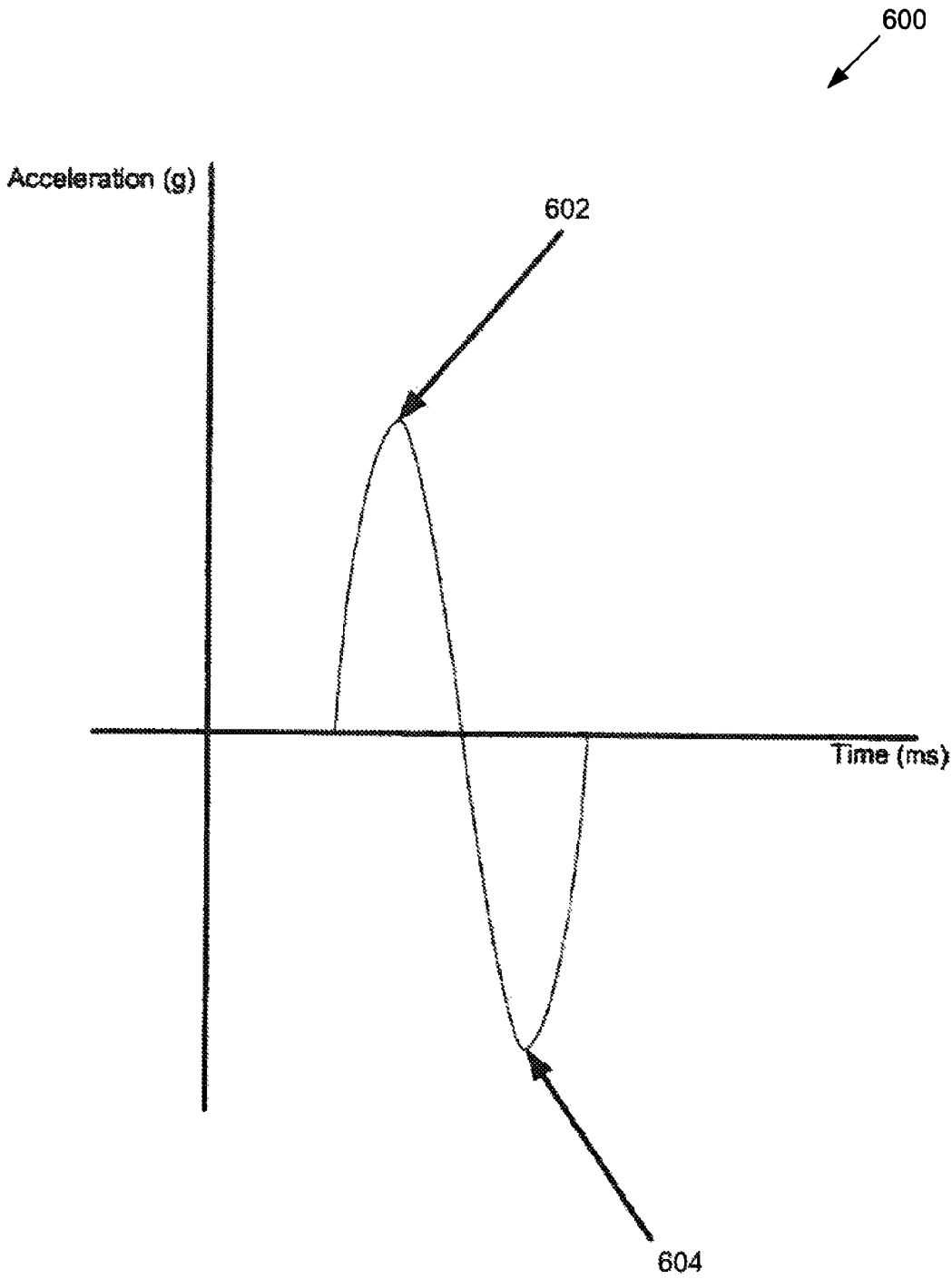
FIG. 6 illustrates an example of a typical acceleration pattern corresponding to a fall in accordance with certain embodiments of the disclosed technology.

At 504, the information received from the accelerometer is evaluated to determine whether a first threshold is exceeded. As used herein, this step may be referred to as a first-level filter. In certain embodiments, the mobile signature analysis unit 104 can first identify two inflection points within a certain period of time, e.g., 512 milliseconds, in one of the spatial directions and determine the difference between the two points. FIG. 6 illustrates an example of a typical acceleration pattern 600 corresponding to a fall event, the acceleration pattern 600 having two inflection points 602 and 604 within a single spatial direction. If the difference between the identified inflection points within the given time window exceeds a certain value, e.g., 2 g of acceleration, the mobile signature analysis unit 104 can designate this first threshold as having been exceeded and the method 500 can continue to 506; otherwise, the method 500 will return to 502.

At 506, a second determination, which may be referred to herein as a second-level filter, is made with respect to the information received from the accelerometer. Here, an energy impulse corresponding to the received signal is evaluated. If the acceleration impulse exceeds a second threshold having a certain value or is within a specified range, e.g., 2.5 g or more, the mobile signature analysis unit 104 can designate this second threshold as having been exceeded and direct the method 500 to proceed to 508; otherwise, the method 500 will return to 502.

At 508, a signature of the signal received from the accelerometer is detected. This can be done, for example, by analyzing the various characteristics and values measured and identified above such as spatial direction changes and energy impulses. The mobile signature analysis unit 104 can also take various reverse time samples as part of the signal detection process. Once the signature of the signal has been detected, the mobile signature analysis unit 104 can perform a signature matching operation, as shown at 510. The mobile signature analysis unit 104 can do this by comparing the detected signal to one or more signal templates that each correspond to a particular event, for example.

In certain embodiments, a signature database located within the mobile signature analysis unit 104 or elsewhere, e.g., within the home unit 102, the computer 118, or the host server 120, can store a library of signature templates. The mobile signature analysis unit 104 can compare the detected signature to one or more of the signature templates stored in the signature database, as shown at 512. For example, the mobile signature analysis unit 104 can first compare the detected signature to one or more signature templates corresponding to a fall event and if there is a positive match, the method 500 can initiate pertinent handling, as shown at 514; otherwise, the method can return to 502.

For example, if the mobile signature analysis unit 104 finds a positive match of the detected signature to the signature template corresponding to a fall at 512, the method 500 can initiate fall-specific event handing at 514. If there is no positive match to the fall signature at 512, however, the mobile signature analysis unit 104 can continue comparing the detected signature to other signature templates stored in the signature database to identify the event. For example, the mobile signature analysis unit 104 can determine whether the monitored event is a clap, a jump, or other non-fall event.

Figure 7:
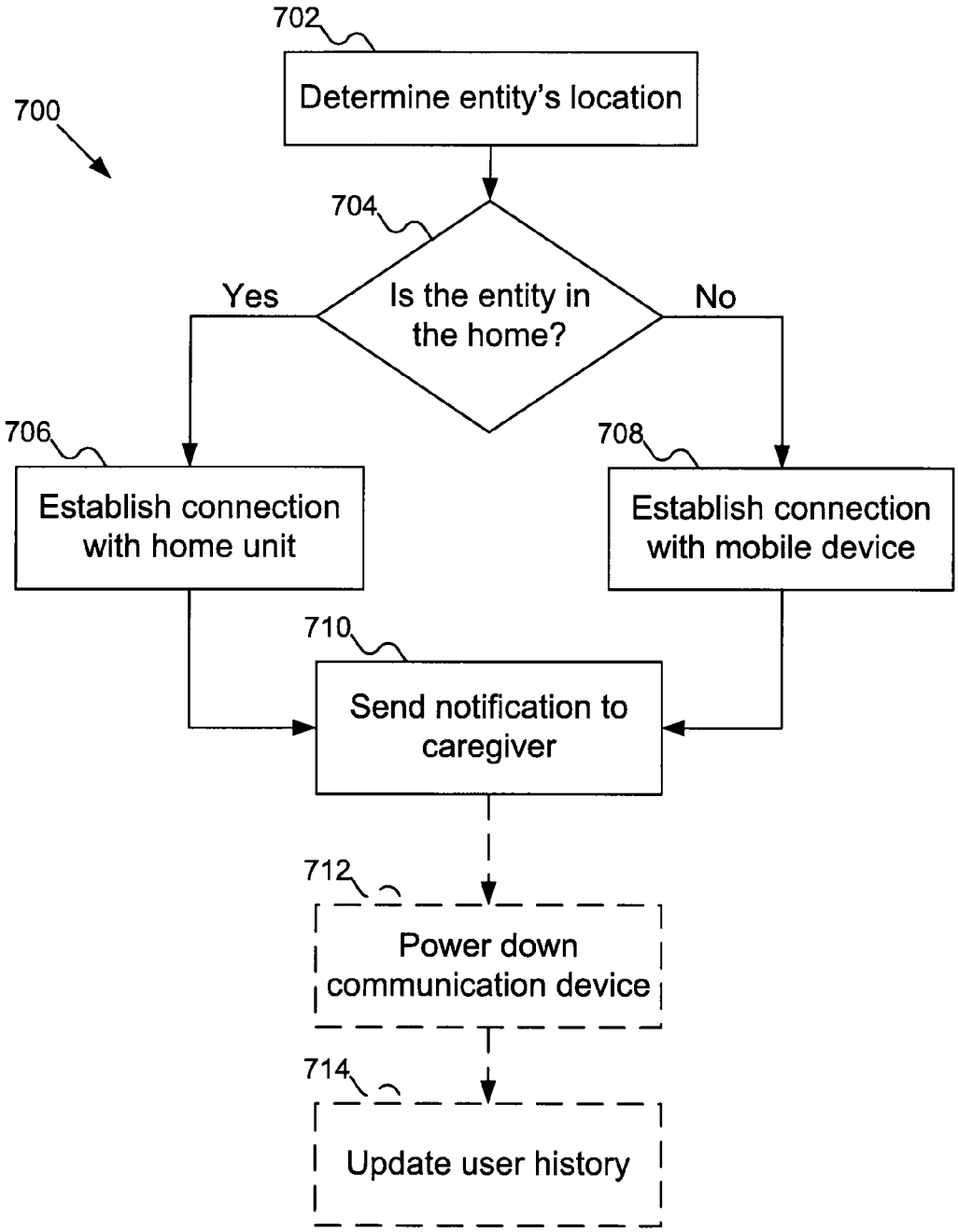
FIG. 7 is a flowchart that illustrates an example of a machine-controlled method of initiating pertinent handling responsive to a positive signature match in accordance with embodiments of the disclosed technology.

FIG. 7 is a flowchart that illustrates an example of a machine-controlled method 700 of initiating pertinent handling responsive to a positive match found by the mobile signature analysis unit 104. At 702, the entity's location is determined. For example, the mobile signature analysis unit 104 can use a GPS module 214 to determine the geographic coordinates of the mobile signature analysis unit 104 and, therefore, the entity presumed to be wearing the mobile signature analysis unit 104. The mobile signature analysis unit 104 can then use the coordinates to determine whether the entity is within range of the home unit 102, as shown at 704. If the entity is within range of the home unit 102, the method 700 can proceed to 706; otherwise the method can proceed to 708.

At 706, the mobile signature analysis unit 104 establishes a connection with the home unit 102. In certain embodiments, the mobile signature analysis unit 104 can establish the connection using a ZigBee transmitter in the mobile signature analysis unit 104 and a ZigBee receiver in the home unit 102. At 708, the mobile signature analysis unit 104 establishes a connection with a mobile communication device 114 such as the user's cellular telephone. The mobile signature analysis unit 104 can connect to the mobile device by way of a Bluetooth connection, for example.

At 710, a notification is sent to one or more caregivers 116. If the mobile signature analysis unit 104 has established a connection with the home unit 102, the home unit 102 can issue the notification to be sent to the caregiver(s) 116 by way of the network 108 using a Wi-Fi connection, for example. Alternatively, the home unit 102 can power up certain radio components to be used as part of the transmission process. If the mobile signature analysis unit 104 has established a connection with a mobile communication device 114, such as a cellular telephone, the mobile communication device 114 can send the notification to the caregiver(s) 116 by way of the network 108.

After the pertinent event alert has been sent, a communication device can be powered down, as shown at 712. In certain embodiments, for example, any of a number of various radio components can be used during the sending process. In these embodiments, the radio components that were used by the mobile signature analysis unit 104 can be powered down once the notification has been sent to conserve power, for example.

In certain embodiments, the user's history can be updated, as shown at 714. For example, information pertaining to the detected event can be sent to one or more of the home unit 102, the computer 118, and the host server 120 to be added to a profile or history for the entity.

General Description of a Suitable Machine in which Embodiments of the Disclosed Technology can be Implemented The following discussion is intended to provide a brief, general description of a suitable machine in which embodiments of the disclosed technology can be implemented. As used herein, the term "machine" is intended to broadly encompass a single machine or a system of communicatively coupled machines or devices operating together. Exemplary machines can include computing devices such as personal computers, workstations, servers, portable computers, handheld devices, tablet devices, and the like.

Typically, a machine includes a system bus to which processors, memory (e.g., random access memory (RAM), read-only memory (ROM), and other state-preserving medium), storage devices, a video interface, and input/output interface ports can be attached. The machine can also include embedded controllers such as programmable or non-programmable logic devices or arrays, Application Specific Integrated Circuits, embedded computers, smart cards, and the like. The machine can be controlled, at least in part, by input from conventional input devices (e.g., keyboards and mice), as well as by directives received from another machine, interaction with a virtual reality (VR) environment, biometric feedback, or other input signal.

The machine can utilize one or more connections to one or more remote machines, such as through a network interface, modem, or other communicative coupling. Machines can be interconnected by way of a physical and/or logical network, such as an intranet, the Internet, local area networks, wide area networks, etc. One having ordinary skill in the art will appreciate that network communication can utilize various wired and/or wireless short range or long range carriers and protocols, including radio frequency (RF), satellite, microwave, Institute of Electrical and Electronics Engineers (IEEE) 545.11, Bluetooth, optical, infrared, cable, laser, etc.

Embodiments of the disclosed technology can be described by reference to or in conjunction with associated data including functions, procedures, data structures, application programs, instructions, etc. that, when accessed by a machine, can result in the machine performing tasks or defining abstract data types or low-level hardware contexts. Associated data can be stored in, for example, volatile and/or non-volatile memory (e.g., RAM and ROM) or in other storage devices and their associated storage media, which can include hard-drives, floppy-disks, optical storage, tapes, flash memory, memory sticks, digital video disks, biological storage, and other tangible, physical storage media.

Associated data can be delivered over transmission environments, including the physical and/or logical network, in the form of packets, serial data, parallel data, propagated signals, etc., and can be used in a compressed or encrypted format. Associated data can be used in a distributed environment, and stored locally and/or remotely for machine access.

Having described and illustrated the principles of the invention with reference to illustrated embodiments, it will be recognized that the illustrated embodiments may be modified in arrangement and detail without departing from such principles, and may be combined in any desired manner. And although the foregoing discussion has focused on particular embodiments, other configurations are contemplated. In particular, even though expressions such as "according to an embodiment of the invention" or the like are used herein, these phrases are meant to generally reference embodiment possibilities, and are not intended to limit the invention to particular embodiment configurations. As used herein, these terms may reference the same or different embodiments that are combinable into other embodiments.

Consequently, in view of the wide variety of permutations to the embodiments described herein, this detailed description and accompanying material is intended to be illustrative only, and should not be taken as limiting the scope of the invention. What is claimed as the invention, therefore, is all such modifications as may come within the scope and spirit of the following claims and equivalents thereto.

The invention claimed is:

1. A mobile signature analysis unit comprising:

a sensor module having at least one accelerometer and configured to monitor and capture activity information corresponding to an entity, the activity information including acceleration information and energy impulse information;

a processing unit configured to:

receive the activity information from the sensor module, detect a signature from the activity information by:

identifying at least two directional changes in the acceleration information in each of at least two spatial directions, wherein each of the at least two directional changes are represented by a corresponding inflection point, determining whether a distance between the inflection points within each spatial direction exceeds a predetermined threshold value, and determining whether a value of the energy impulse information exceeds an energy impulse threshold value, and determine an activity type corresponding to the detected signature;

a communication module configured to establish communication with a home unit, wherein the home unit is configured to issue a notification reporting the determined activity type corresponding to the detected signature; and an external communication module configured to establish communication with at least one mobile communication device using a corresponding one of a plurality of communication techniques, wherein the at least one mobile communication device is configured to issue the notification reporting the determined activity type corresponding to the detected signature.

2. The mobile signature analysis unit of claim 1, wherein the communication established with the home unit comprises a wireless connection.

3. The mobile signature analysis unit of claim 2, wherein the wireless connection comprises a ZigBee connection.

4. The mobile signature analysis unit of claim 2, wherein the home unit is configured to issue the notification over a wireless connection.

5. The mobile signature analysis unit of claim 1, wherein the communication established with the at least one mobile communication device comprises a wireless connection.

6. The mobile signature analysis unit of claim 5, wherein the wireless connection comprises a Bluetooth connection.

7. The mobile signature analysis unit of claim 1, further comprising a battery unit configured to be recharged by the home unit.

8. The mobile signature analysis unit of claim 1, wherein the entity is wearing the mobile signature analysis unit.

9. The mobile signature analysis unit of claim 1, wherein the determined activity type corresponds to a fall event.

10. A machine-controlled method comprising:

a mobile signature analysis unit monitoring activity information corresponding to an entity, the activity information comprising acceleration information and energy impulse information;

a sensor module of the mobile signature analysis unit capturing the activity information and sending the activity information to a processing unit of the mobile signature analysis unit;

the processing unit of the mobile signature analysis unit detecting a signature from the activity information by identifying within the acceleration information a plurality of direction changes in each of at least two spatial directions and further by determining whether a value of the energy impulse information exceeds an energy impulse threshold;

the processing unit of the mobile signature analysis unit determining an activity event corresponding to the detected signature by comparing the detected signature to at least one signature template; and responsive to determining the activity event corresponding to the detected signature, the mobile signature analysis unit establishing communication with at least one caregiver and issuing a notification to the at least one caregiver, the notification reporting the determined activity.

11. The machine-controlled method of claim 10, wherein establishing communication with at least one caregiver comprises determining whether the mobile signature analysis unit is within range of a home unit.

12. The machine-controlled method of claim 11, wherein, responsive to a determination that the mobile signature analysis unit is within range of the home unit, the issuing comprises the home unit sending the notification to the at least one caregiver.

13. The machine-controlled method of claim 11, wherein, responsive to a determination that the mobile signature analysis unit is not within range of the home unit, the issuing comprises a mobile communication unit sending the notification to the at least one caregiver.

14. The machine-controlled method of claim 10, further comprising editing information identifying the at least one caregiver.

* * * * *